US011237522B2

(12) United States Patent
Carr

(10) Patent No.: US 11,237,522 B2
(45) Date of Patent: Feb. 1, 2022

(54) DIAL CLOCK WITH COUNTER-ROTATING INDICATORS

(71) Applicant: Joseph Nick Carr, Durham, NC (US)

(72) Inventor: Joseph Nick Carr, Durham, NC (US)

( * ) Notice: Subject to any disclaimer, the term of this patent is extended or adjusted under 35 U.S.C. 154(b) by 126 days.

(21) Appl. No.: 16/710,327

(22) Filed: Dec. 11, 2019

(65) Prior Publication Data

US 2021/0181680 A1 Jun. 17, 2021

(51) Int. Cl.
*G04B 19/06* (2006.01)
*G04B 19/04* (2006.01)

(52) U.S. Cl.
CPC ..... *G04B 19/06* (2013.01); *G04B 19/04* (2013.01)

(58) Field of Classification Search
CPC ..... G04B 19/06; G04B 19/04; G04B 19/23; G04B 47/008; G04B 47/06; G04B 47/065; G04B 19/082; G04C 3/146; G04C 17/00; G04G 21/02; G04G 9/0064
USPC ..... 368/223
See application file for complete search history.

(56) References Cited

U.S. PATENT DOCUMENTS 7,889,602 B2 * 2/2011 Behling ..... G04C 17/0066 368/10
9,459,590 B1 * 10/2016 Lecher ..... G04C 17/0091
2003/0076746 A1 * 4/2003 Palmer ..... G04B 19/085 368/80
2004/0233788 A1 * 11/2004 Plancon ..... G04B 19/23 368/11
2007/0140063 A1 * 6/2007 Shu ..... G04B 19/065 368/46
2007/0201316 A1 * 8/2007 Shu ..... G04C 17/00 368/223

* cited by examiner

*Primary Examiner* — Edwin A. Leon

(57) ABSTRACT

A clock comprises a dial comprising two or more positions. Each position has an associated time value and the associated time values of the two or more positions increase in a first clock direction around the dial. An indicator provided in combination with the dial indicates a position on the dial with respect to the two or more markings that represents a time. An actuator provides a motive force to move the indicator from one position to another position on the dial under the control of a controller so that the indicator transitions from a first time to a later second time by moving the indicator in a second clock direction opposite the first clock direction around the dial. The clock can comprise one or more indicators, actuators, and sensors for sensing the position of each indicator. Indicators can be clock hands, for example minute, hour, or second hands.

19 Claims, 9 Drawing Sheets

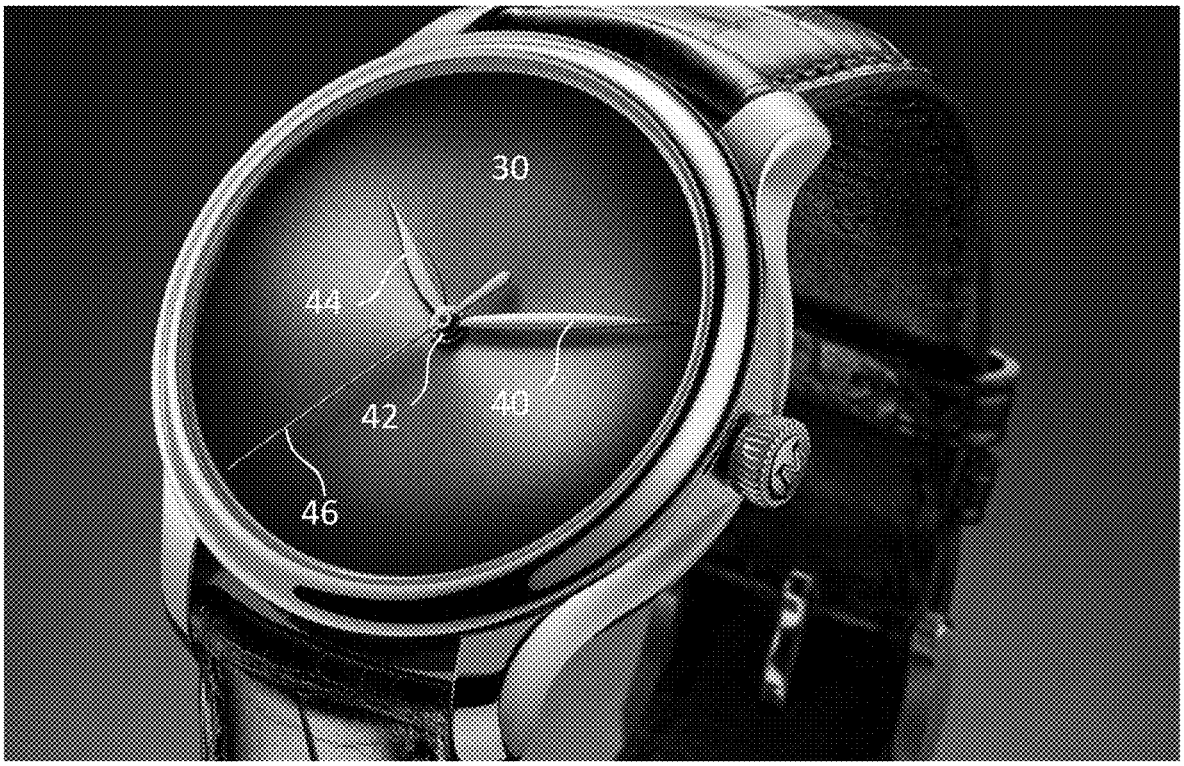
*FIG. 9 – Prior Art*

DIAL CLOCK WITH COUNTER-ROTATING INDICATORS

FIELD

The present disclosure relates to a dial clock or other timepiece with a dial face and hands for telling the time. In particular, the present disclosure relates to structures and circuits for providing counter-rotating indicators for a dial clock.

BACKGROUND

Dial clocks have been used for many years and include a face, often with markings, numbers, or a combination of markings and numbers with progressively increasing values in a clockwise direction on the face that represent the time in either 12-hour or 24-hour format. Some clocks have no markings on the face, and the time is inferred by the viewer's normal knowledge of clock faces. The current time is usually indicated with one or more clockwise-rotating indicators, for example an hour hand referencing the hour and a minute hand referencing the minute. The rotation of the indicators is continuous or stepwise continuous having average rotational velocity consistent with the function of the indicator. For example, for a 12-hour format clock, the hour hand rotates clockwise one complete revolution every 12 hours, equivalent to 30 degrees per hour. The minute hand rotates clockwise one complete revolution every one hour, equivalent to six degrees per minute. The hour hand and minute hand are usually mechanically connected through a reducing gear train. For example, in the case of a typical 12-hour clock, the minute hand is driven by an actuator, usually a motor, weights, or a spring. The actuator is controlled by a controller that provides a means of accurately measuring the passage of time. The actuator may be a pendulum, escapement, electronic (crystal) oscillator, power line frequency monitor or other means to accurately measure the passage of time. The hour hand is driven by the minute hand via a divide-by-12 gear train.

There are also examples of novelty clocks with faces having counter-clockwise markings, numbers, or both and counter-clockwise rotating indicators, for example an hour hand referencing the hour and a minute hand referencing the minute. The indicators are otherwise controlled in a manner similar to a conventional, clockwise-rotating clock.

Clocks can also have various day and date indicators, lunar cycle functions, or chimes or any combination of these indicating the time, or clocks can have other mechanical, electrical, or optical devices or functions related to the time indicated by the clock (e.g., cuckoo clocks, timers, or alarms). Such additional functionality beyond indicating the time are commonly referred to as "complications".

Clocks are often used not only for telling time but for decoration, as an artwork, as jewelry, and for entertainment. There is a need, therefore, for dial clock designs that provide increased interest and entertainment and for structures and mechanisms that implement such designs.

SUMMARY

According to some embodiments of the present disclosure, a clock comprises a dial comprising two or more positions, each position having an associated time value. Any one of the two or more positions can be indicated with a mark on the dial, such as a numeral, dot, or dash. The associated time values of the two or more positions increase in a first clock direction around the dial. An indicator provided in combination with the dial indicates a position on the dial with respect to the two or more positions that represents a time. A position can be a location on the dial or an orientation of the indicator with respect to the dial or to two or more dial positions. An actuator provides a motive force to move the indicator from one position to another position on the dial. A controller controls the actuator to position the indicator with respect to the two or more positions so that the indicator transitions from representing a first time to representing a later time by moving the indicator in a second clock direction opposite the first clock direction around the dial.

The rotation of the indicator can be intermittent, having little or no rotation for the majority of a defined time period (the viewing period), followed by a shorter period of rapid counter-rotational movement in the second clock direction to a representation of a later time (the movement period). For example, in some embodiments, the minute hand will remain motionless for the majority of a minute, then rotate relatively rapidly in the second clock direction, stopping at a position representing the later time. This cycle repeats every minute. Therefore, according to some embodiments of the present disclosure and contrary to many conventional clocks, the indicator moves only at defined times and during defined time periods.

In some embodiments, the first clock direction is a clockwise direction and the second clock direction is a counterclockwise direction. In some embodiments, the first clock direction is a counterclockwise direction and the second clock direction is a clockwise direction.

In some embodiments, each position of the two or more positions is indicated with a mark on the dial. In some embodiments at least one but less than all positions of the two or more positions are indicated with a mark on the dial. In some embodiments, all of the marks are a numeral, all of the marks are a dot, or all of the marks are a dash. In some embodiments, some but not all of the marks are a numeral, some but not all of the marks are a dot, or some but not all of the marks are a dash, or any combination of these.

In some embodiments of the present disclosure, the indicator moves fewer than 360 degrees around the dial in the second clock direction to indicate a transition from a first time to a second time later than the first time. In some embodiments, the indicator moves substantially 354 degrees or moves substantially 330 degrees in the second clock direction to indicate a transition from a first time to a second time later than the first time.

In some embodiments, the indicator is a first indicator and the clock comprises a second indicator provided in combination with the dial. The second indicator indicates a position on the dial with respect to the two or more positions that represents a time. The clock can transition from representing a first time to representing a second time later than the first time by moving the second indicator in the first clock direction or the clock can transition from representing a first time to representing a second time later than the first time by moving the second indicator in the second clock direction.

In some embodiments, the two or more positions are indicated with a first marking having a first associated value and a second marking having a second associated value greater than the first associated value. The second indicator can move in the first clock direction or the second clock direction from the first marking to the second marking to indicate a transition from a first time to a second later time. The first and second markings can be numerals corresponding to time values, for example a '1' and a '2' signifying one o'clock and two o'clock, respectively.

In some embodiments, the second indicator moves in the first clock direction from a first time to a second time for some portion of a time period defined by the time difference between the first and second times. For the remaining portion of the time period, the second indicator moves in the second clock direction.

In some embodiments of the present disclosure, the actuator is an electric motor, a servo motor, a stepper motor, an escapement, a pendulum with weights, a solenoid, or a spring.

In some embodiments, the indicator is a first indicator and the clock comprises a second indicator provided in combination with the dial and the actuator provides a motive force to move the second indicator.

In some embodiments of the present disclosure, the indicator is directly driven by the actuator or the indicator is indirectly driven by the actuator. In some embodiments, the indicator is indirectly driven by the actuator with any subset of the set comprising gears, pulleys, wheels, belts, linkages and magnets. If the clock comprises a second indicator, the second indicator can be driven similarly to the indicator.

In some embodiments, the actuator is a first actuator and the clock comprises a second actuator controlled by the controller. In some embodiments, the actuator is a first actuator, the indicator is a first indicator, and the clock comprises a second indicator provided in combination with the dial and a second actuator that provides a motive force to move the second indicator.

In some embodiments, the indicator is a first indicator, a second indicator is provided in combination with the dial, and the first and second indicators rotate about a common axis. In some embodiments, the first and second indicators rotate about different axes.

In some embodiments, the clock comprises a sensor that senses the position of the indicator. In some embodiments, the indicator is a first indicator, the sensor is a first sensor, and the clock comprises a second indicator provided in combination with the dial and a second sensor that senses the position of the second indicator.

Clocks of the present disclosure can have additional complications, such as, but not limited to, day and date functions, lunar cycles, alarm functions, timing functions.

Embodiments of the present disclosure provide a dial clock with progressive clockwise markings and counter-rotating indicators having increased interest, novelty, enjoyment, and entertainment value.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which:

FIG. 9 is an image of a prior-art clock without markings useful in understanding embodiments of the present disclosure.

Figure 1:
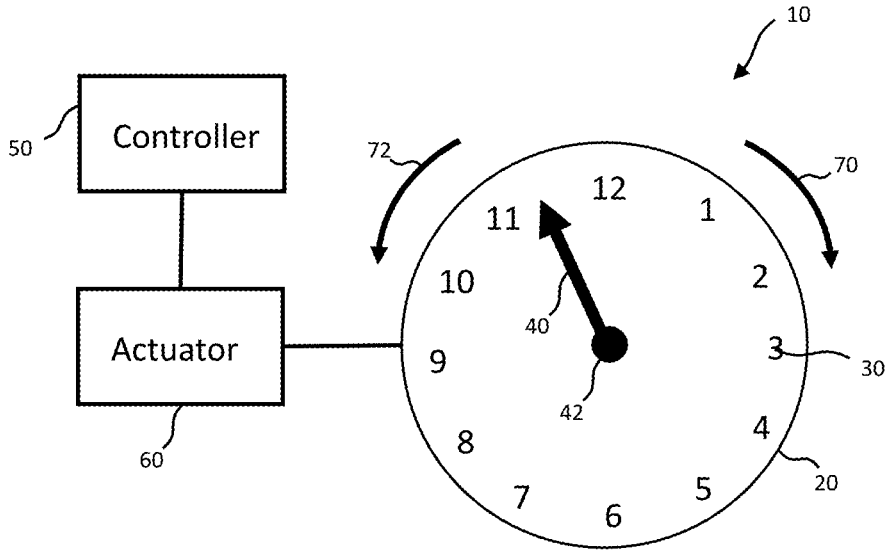
FIGS. 1-8 are schematic diagrams of illustrative embodiments of the present disclosure.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF EMBODIMENTS

Clocks are generally instruments for measuring and recording time, especially by mechanical or electronic means, usually with hands or changing numbers to indicate a time, for example the present hour, minute, and sometimes second, or even portions of a second. As shown in FIG. 1, embodiments of the present disclosure provide a clock 10 comprising a dial 20 comprising two or more positions or locations indicated in the figures by markings 30. Each position has an associated time value that can be indicated by a marking 30 and the associated time values of the two or more positions indicated by markings 30 increase in a first clock direction 70 around dial 20. An indicator 40 that rotates about an axis 42 can be provided in combination with dial 20. Indicator 40 indicates a position on dial 20 with respect to two or more markings 30 that specify or correspond to a time. Under the control of a controller 50, an actuator 60 provides a motive force that moves indicator 40 from one position to another position on dial 20 and thereby sets the position and orientation of indicator 40 with respect to the positions indicated by two or more markings 30 so that indicator 40 transitions from representing a first time to representing a second time later than the first time by moving indicator 40 in a second clock direction 72 opposite first clock direction 70 around dial 20. A later second time is a time after or subsequent to the first time. For example, two o'clock is a later time than one o'clock in a single day. For clarity herein, a position or location on dial 20 indicated by a corresponding marking 30 is interchangeably referred to as the corresponding marking 30. A marking 30 can be a mark or marker or other graphic indicator.

Figure 2:
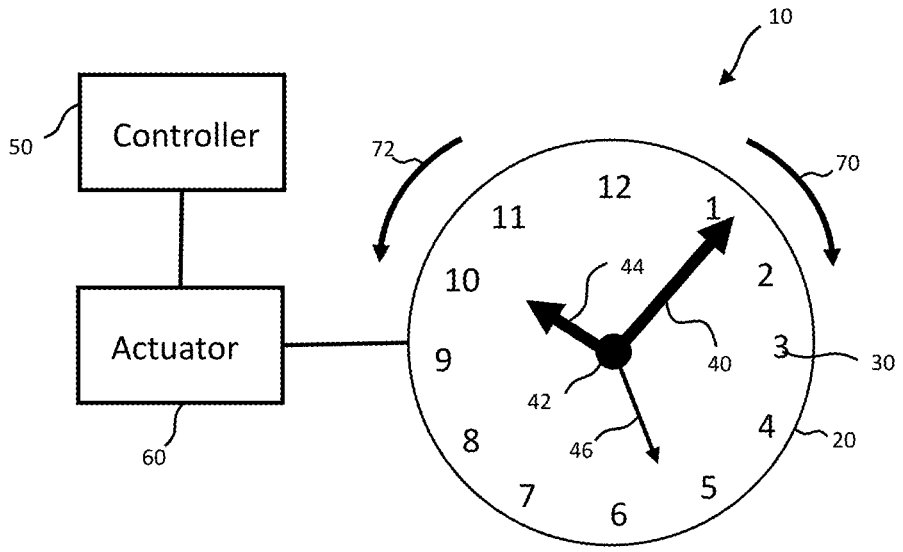

In some embodiments, dial 20 is a clock face and markings 30 are hour markings or minute markings or both. In some embodiments of the present disclosure, clock 10 can comprise first, second, and third indicators 40, 44, 46 for example corresponding to minute, hour, and second hands respectively or any combination of those, as shown in FIG. 2. One or more indicators 40, 44, 46 can, but do not necessarily, rotate about a common axis 42. Markings 30 can be numbers or numerals (as shown in FIG. 1), for example numbers having values associated with a time or time duration. In some embodiments, some markings 30 are ordinal numbers, line segments, dashes, dots or other graphic marks, either with or without explicit values. In some embodiments, some markings 30 are numerals and other markings 30 on the same dial 20 are dots or other non-numeric graphics disposed between numerals. Non-numeric graphic markings 30 can have implicit values provided by cultural context or expectations and are considered herein to have an increase in value in first clock direction 70. For example, a conventional clock can have twelve markings 30 spaced around the center of a clock face. If the twelve markings 30 are numeric, they are generally labelled with the numbers one to twelve (e.g., '1' to '12'), with the twelve at the top of the clock face and the numbers one to eleven ordered around the face in a clockwise direction. If the twelve markings 30 are non-numeric, it is understood that each marking 30 is associated with the numbers one to twelve as found on a conventional number clock face of dial 20. In some embodiments of the present disclosure, the positions are implicit and are not indicated with markings 30. In such embodiments, the positions are understood to have implicit values provided by cultural context or expectations or by education. Since users of clock 10 are accustomed to other clocks with markings 30, they implicitly assume the values of the positions, even in the absence of corresponding markings 30.

As used herein, a dial 20 can be a plate, disk, face, or other surface containing markings 30 or figures upon which the time of day is indicated by hands, pointers, or shadows. Dial 20 can comprise a metal, paper, plastic, wood, cloth, or other surface on which markings 30 are indicated, for example by printed ink, embossings, imprintings, threads, or other graphic markings and can be made using stamping, printing, weaving, sewing or other known manufacturing or construction methods. In some embodiments, indicators 40 are metal, wooden, or plastic pointers having a length greater than a width and a thickness less than the width that extends from an axis 42 to, beyond, or at least partly towards markings 30. Indicator 40 can rotate about axis 42 under the control of controller 50 and by the motive force of actuator 60.

Figure 3:
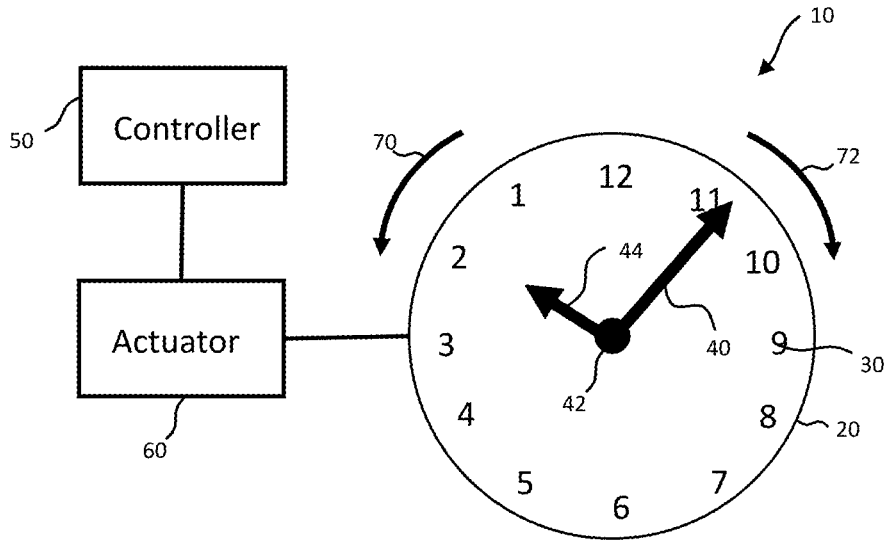

In some embodiments, first clock direction 70 is a clockwise direction and second clock direction 72 is a counterclockwise direction (as shown in FIG. 1). In some embodiments, first clock direction 70 is a counterclockwise direction and second clock direction 72 is a clockwise direction (as shown in FIG. 3). Indicator 40 can move fewer than 360 degrees around dial 20, for example can move substantially 354 degrees in second clock direction 72 around dial 20. A substantial movement is one made within the limitations of a manufacturing process or a control mechanism and is not necessarily exact. An indicator 40 rotation of 354 degrees is 59/60 of a complete rotation (360 degrees) around dial 20 and therefore corresponds to a movement on dial 20 corresponding to a time period of 59 minutes. A rotation of indicator 40 corresponding to a time period of 59 minutes in second clock direction 72 is equivalent to rotating indicator 40 an amount corresponding to a time period of one (1) minute in first clock direction 70.

In some embodiments of the present disclosure and as shown in both FIGS. 1 and 2, indicator 40 is a first indicator 40 and clock 10 comprises a second indicator 44 provided in combination with dial 20. Second indicator 44 indicates a position on dial 20 with respect to the two or more positions 30 that specifies a time. For example, first indicator 40 can be a minute hand and second indicator 44 can be an hour hand. In some embodiments, first or second indicators 40, 44, or third indicator 46, can be a second hand (not shown in the figures). A first position 30 of the two or more positions 30 can have a first associated value and a second position 30 of the two or more positions 30 can have a second associated value greater than the first associated value. In embodiments, second indicator 44 moves from first position 30 to second position 30 in either first or second clock directions 70, 72.

Second indicator 44 can move fewer than 360 degrees, for example, can move substantially 330 degrees in second clock direction 72 around dial 20. A second indicator 44 rotation of 330 degrees is eleven twelfths of a complete rotation (360 degrees) around dial 20 and therefore corresponds to a movement of second indicator 44 corresponding to a time period of 11 hours on dial 20. A rotation of second indicator 44 corresponding to a time period of 11 hours in second clock direction 72 is equivalent to a movement of second indicator 44 corresponding to a time period of one (1) hour in first clock direction 70.

In some embodiments, clock 10 transitions from representing a first time to representing a second time later than the first time by moving second indicator 44 in first clock direction 70 (e.g., from first position 30 to second position 30). In some embodiments, clock 10 transitions from representing a first time to representing a second time later than the first time by moving second indicator 44 in second clock direction 72. For example, an hour hand (e.g., second indicator 44) can rotate in a counterclockwise direction for 11/12 of a complete rotation to move from an hour to an immediately successive hour. By moving second indicator 44 in a counterclockwise direction, a clock 10 observer can derive additional interest, novelty, enjoyment, and entertainment from clock 10.

In some embodiments, second indicator 44 moves in first clock direction 70 from a first time to a second time for some portion of a time period defined by the time difference between the first and second times. For the remaining portion of the time period, second indicator 44 moves in second clock direction 72. For example, a minute hand can move in first clock direction 70 (e.g., a clockwise direction) for the first 59 minutes and 59 seconds of an hour and then rotates in second clock direction 72 (e.g., a counterclockwise direction) for the remaining second in the hour.

Figure 4:
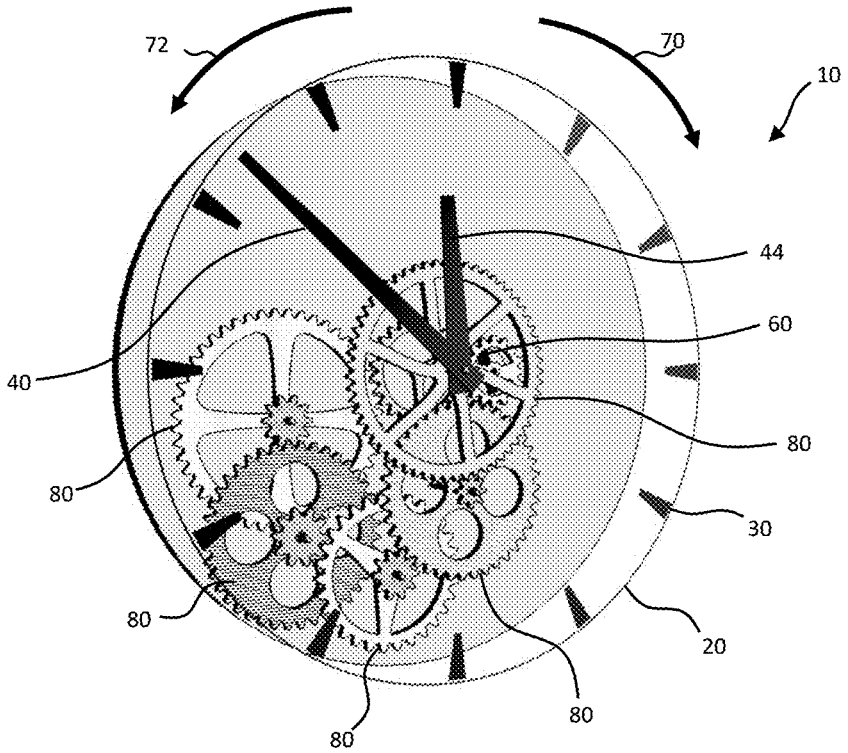
Figure 5:
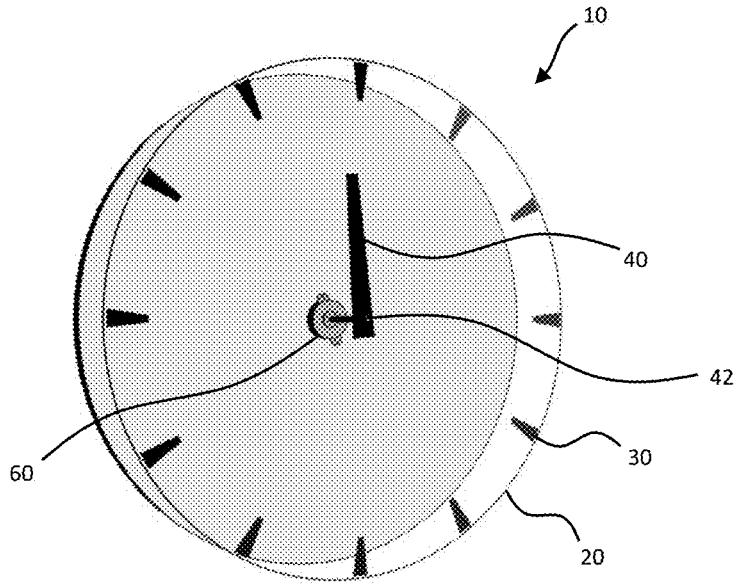

In some embodiments, as shown for example in FIG. 4, indicator 40 is a first indicator 40 and clock 10 comprises a second indicator 44 provided in combination with dial 20. Actuator 60 provides a motive force to indirectly move first indicator 40 and second indicator 44 through any combination of gears 80, pulleys, linkages, couplers or magnets. As shown in FIG. 5, in some embodiments indicator 40 is directly driven by actuator 60.

In some embodiments of the present disclosure, as shown in FIGS. 1-5, actuator 60 comprises any one or combination of a brushed motor, a brushless motor, a stepper motor, a synchronous motor, a hydraulic motor, an escapement, a pendulum with weights, a solenoid, or a spring.

Figure 6:
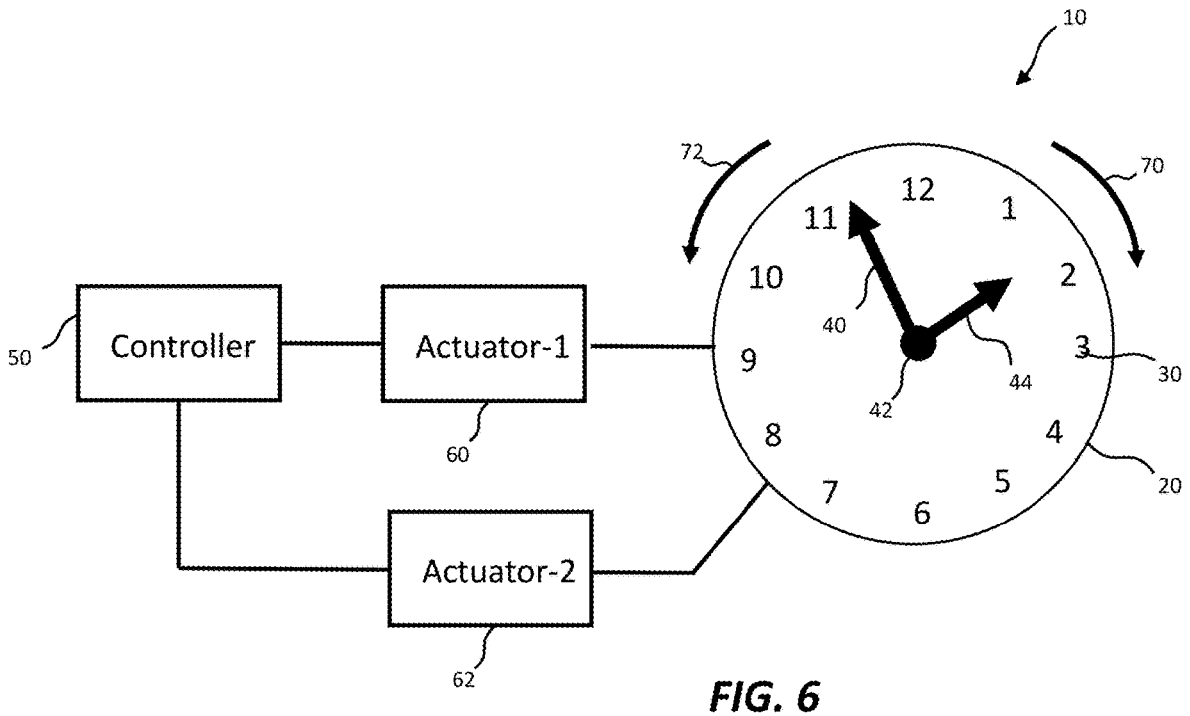

As shown in FIG. 6, in some embodiments of clock 10 actuator 60, controlled by controller 50, is a first actuator 60 and indicator 40 is a first indicator 40. Clock 10 can comprise a second indicator 44 provided in combination with dial 20 and a second actuator 62, controlled by controller 50, that provides a motive force to move second indicator 44. First and second indicators 40, 44 are therefore capable of independent movement, adding novelty, increased interest, and entertainment to clocks 10 of the present disclosure.

In some embodiments of the disclosure, as shown in FIG. 6, second actuator 62 comprises any one or combination of a brushed motor, a brushless motor, a stepper motor, a synchronous motor, a hydraulic motor, an escapement, a pendulum with weights, a solenoid, or a spring. In some embodiments, both first actuator 60 and second actuator 62 comprise any one or combination of a brushed motor, a brushless motor, a stepper motor, a synchronous motor, a hydraulic motor, an escapement, a pendulum with weights, a solenoid, or a spring.

Figure 7:
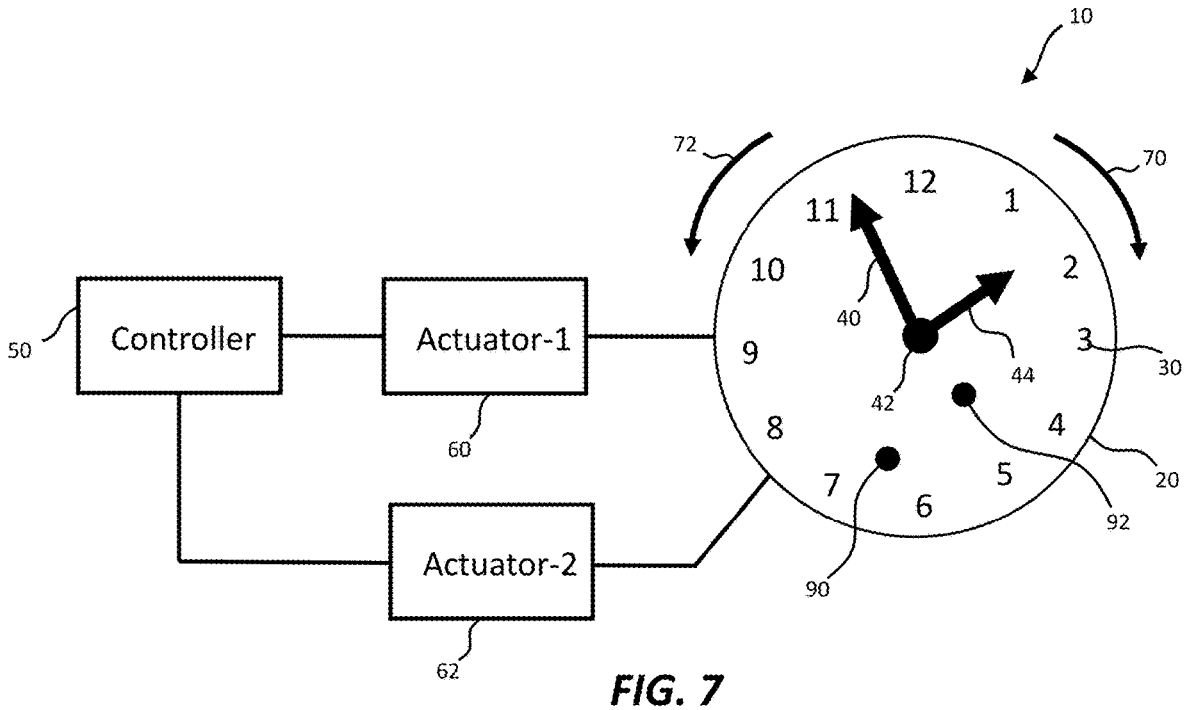

As shown in FIG. 7, clock 10 comprises a sensor 90 that senses a rotational position of indicator 40 by any method, including, but not limited to optical, magnetic, resistive, capacitive, electrical contact or servo-motor feedback. In some embodiments and as shown in FIG. 7, indicator 40 is a first indicator, sensor 90, is a first sensor 90, and clock 10 comprises a second indicator 44 provided in combination with dial 20 and a second sensor 92 that senses the rotational position of second indicator 44 by any method, including, but not limited to optical, magnetic, resistive, capacitive, electrical contact or servo-motor feedback.

In some embodiments and as shown in FIG. 1, indicator 40 is a first indicator 40 and clock 10 comprises a second indicator 44 provided in combination with dial 20, and first and second indicators 40, 44 rotate about a common axis 42.

Figure 8:
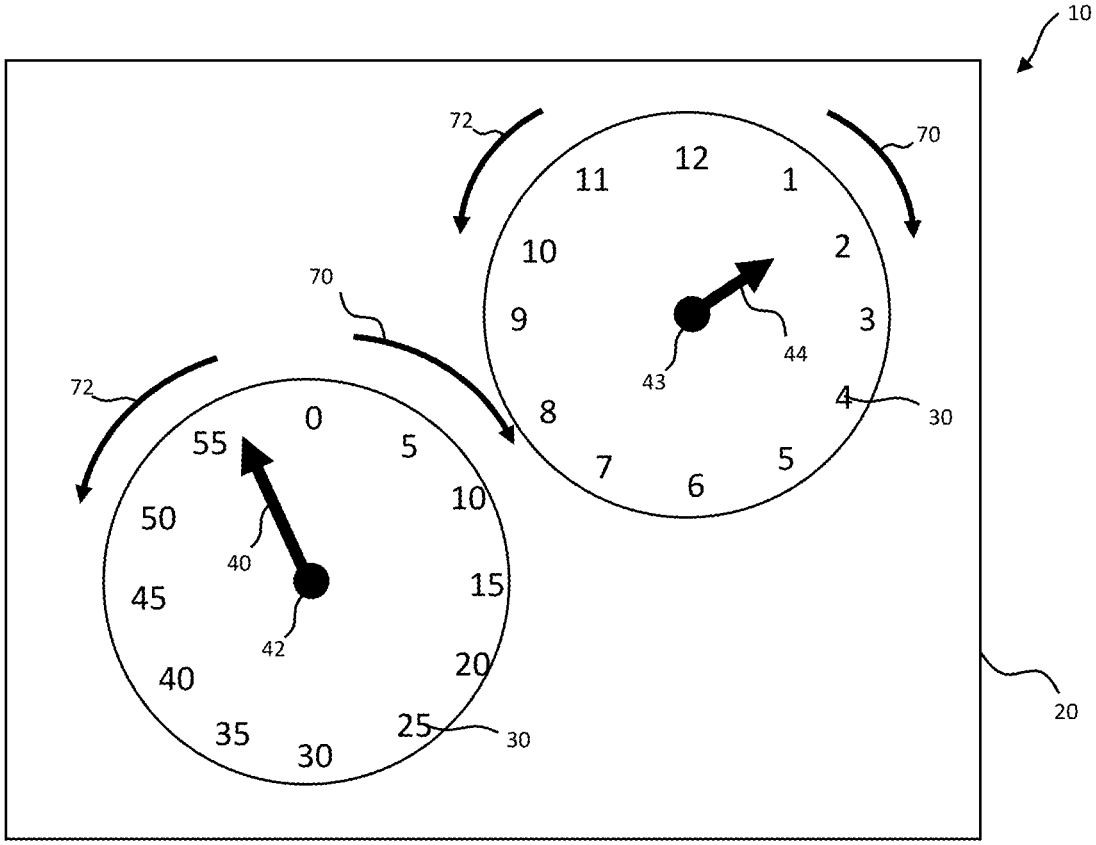

As shown in FIG. 8, indicator 40 is a first indicator 40 and clock 10 comprises a second indicator 44 provided in combination with dial 20. First indicator 40 rotates about axis 4 and second indicator 44 rotates about a different axis 43.

In some embodiments of clock 10, each position of the two or more positions is indicated with a mark on dial 20, at least one but less than all positions of the two or more positions are indicated with a mark on dial 20, or each position of the two or more positions is not indicated on dial 20. In some embodiments, all of markings 30 are a numeral, all of markings 30 are a dot, or all of markings 30 are a dash. In some embodiments, some but not all of markings 30 are a numeral, some but not all of markings 30 are a dot, or some but not all of markings 30 are a dash.

Having described certain embodiments, it will now become apparent to one of skill in the art that other embodiments incorporating the concepts of the disclosure may be used. Therefore, the invention should not be limited to the described embodiments, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain actions is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

10 clock
20 dial
30 position/marking
40 indicator/first indicator
42 axis
43 different axis
44 second indicator
46 third indicator
50 controller
60 actuator/first actuator
62 second actuator
70 first clock direction
72 second clock direction
80 gear
90 sensor/first sensor
92 second sensor

What is claimed:

1. A clock, comprising:

a dial comprising two or more positions on the dial, each position having an associated time value, and wherein the associated time values of the two or more positions increase in a first direction around the dial;

an indicator provided in combination with the dial, the indicator indicating a position on the dial with respect to the two or more positions that represents a time;

an actuator providing a motive force to move the indicator from one position to another position on the dial; and a controller for controlling the actuator to position the indicator with respect to the two or more positions so that the indicator transitions from representing a first time to representing a second time later than the first time by moving the indicator in a second direction opposite the first direction around the dial comprising the two or more positions whose associated time values increase in a first direction around the dial.

2. The clock of claim 1, wherein the first direction is a clockwise direction and the second direction is a counter-clockwise direction.

3. The clock of claim 1, wherein the first direction is a counter-clockwise direction and the second direction is a clockwise direction.

4. The clock of claim 1, wherein the indicator moves more than 30 degrees and less than 360 degrees around the dial, moves substantially 354 degrees around the dial, or moves substantially 330 degrees around the dial when moving from a first position of the two or more positions on the dial to a second position of the two or more positions on the dial.

5. The clock of claim 1, wherein the indicator is a first indicator and comprising a second indicator provided in combination with the dial, the second indicator indicating a position on the dial with respect to the two or more positions that specifies a time.

6. The clock of claim 5, wherein the clock transitions from representing a first time to representing a second time later than the first time by moving the second indicator in the second direction.

7. The clock of claim 5, wherein the clock transitions from representing a first time to representing a second time later than the first time by moving the second indicator in the first direction.

8. The clock of claim 1, wherein the indicator is a first indicator and comprising a second indicator provided in combination with the dial, and wherein the actuator provides a motive force to move the second indicator.

9. The clock of claim 1, wherein the actuator comprises a brushed electric motor, a brushless electric motor, a stepper motor, a synchronous motor, a hydraulic motor, an escapement, a pendulum with weights, a solenoid, or a spring.

10. The clock of claim 1, wherein the indicator is directly driven by the actuator.

11. The clock of claim 1, wherein the indicator is indirectly driven by the actuator with any subset of the set comprising gears, pulleys, belts, linkages, and magnets.

12. The clock of claim 1, wherein the actuator is a first actuator and comprising a second actuator.

13. The clock of claim 1, wherein the actuator is a first actuator and the indicator is a first indicator, and comprising a second indicator provided in combination with the dial and a second actuator that provides a motive force to move the second indicator.

14. The clock of claim 12, wherein the second actuator comprises a brushed electric motor, a brushless electric motor, a stepper motor, a synchronous motor, a hydraulic motor, an escapement, a pendulum with weights, a solenoid, or a spring.

15. The clock of claim 1, comprising a sensor that senses the position of the indicator.

16. The clock of claim 15, wherein the indicator is a first indicator and comprising a second indicator provided in combination with the dial, wherein the sensor is a first sensor, and comprising a second sensor that senses the position of the second indicator.

17. The clock of claim 1, wherein the indicator is a first indicator and comprising a second indicator provided in combination with the dial, and wherein the first and second indicators rotate about a common axis.

18. The clock of claim 1, wherein each position of the two or more positions is indicated with a mark on the dial, wherein at least one but less than all positions of the two or more positions are indicated with a mark on the dial, or wherein each position of the two or more positions is not indicated on the dial.

19. The clock of claim 18, wherein all of the marks are a numeral, all of the marks are a dot, or all of the marks are a dash, or wherein some but not all of the marks are a numeral, some but not all of the marks are a dot, or some but not all of the marks are a dash.

* * * * *